US006163987A

United States Patent [19]

Schommer

[11] Patent Number: 6,163,987

[45] Date of Patent: Dec. 26, 2000

[54] REMOVABLE BLADE ASSEMBLY FOR TRENCHER MACHINE

[76] Inventor: Robert Albert Schommer, N4326 Country Gate Ct., Black Creek, Wis. 54106

[21] Appl. No.: 09/227,453

[22] Filed: Jan. 8, 1999

[51] Int. Cl.[7] ..... E02F 3/76

[52] U.S. Cl. ..... 37/407; 37/379; 172/247; 172/250; 172/253; 172/817; 172/818

[58] Field of Search ..... 37/352, 355, 367, 37/379, 380, 189, 190, 462, 463, 464, 465, 270, 403, 407, 409; 172/810, 245, 247, 249, 250, 253, 817, 818

[56] References Cited

U.S. PATENT DOCUMENTS

| | | | |
|---|---|---|---|
| 3,422,553 | 1/1969 | Holloway | 37/50 |
| 3,754,341 | 8/1973 | Caldwell et al. | 37/86 |
| 3,858,662 | 1/1975 | Reid | 172/297 |
| 4,023,287 | 5/1977 | de Brito . | |
| 4,103,441 | 8/1978 | Flippin . | |
| 4,130,952 | 12/1978 | Dion . | |
| 4,217,001 | 8/1980 | Youngers et al. . | |
| 4,464,852 | 8/1984 | Rice . | |
| 4,475,604 | 10/1984 | Albertson et al. | 175/85 |
| 4,827,636 | 5/1989 | Emming . | |
| 4,833,797 | 5/1989 | Slunecka et al. | 37/86 |
| 4,890,399 | 1/1990 | Stiff et al. | 37/86 |
| 4,987,689 | 1/1991 | Kaczmarski et al. | 37/195 |
| 5,033,214 | 7/1991 | Kaczmarski et al. | 37/81 |
| 5,189,817 | 3/1993 | Schroeder . | |
| 5,228,221 | 7/1993 | Hillard et al. . | |
| 5,411,102 | 5/1995 | Nickels et al. | 172/781 |
| 5,560,129 | 10/1996 | Rothbart . | |
| 5,674,046 | 10/1997 | Meyer | 414/686 |
| 5,813,151 | 9/1998 | Stephens et al. | 37/352 |

*Primary Examiner*—Victor Batson
*Attorney, Agent, or Firm*—Brian G. Gilpin; Godfrey & Kahn, S.C.

[57] ABSTRACT

A removable blade assembly with an attachment arm slidably mounted over the support boom of a trencher machine. The attachment arm is stabilized in place on the support boom with pressure point bolts. From the attachment arm extend an angle support and an extending support block to stabilize a stabilization post leading to the blade-pivot assembly. The blade-pivot assembly includes a blade assembly pivotally mounted on a triangular-shaped housing frame. The blade can be swiveled in each direction from the trencher machine to backfill debris as desired.

12 Claims, 2 Drawing Sheets

REMOVABLE BLADE ASSEMBLY FOR TRENCHER MACHINE

FIELD OF THE INVENTION

The present invention relates to accessories for trenching machines and, more particularly, to a removable blade assembly for a trencher machine.

BACKGROUND OF THE INVENTION

A typical trenching machine, e.g., the one disclosed in U.S. Pat. No. 5,228,221 to Hillard et al., has a digging boom which is connected to a tractor for pivotal movement. A toothed digging chain is rotatably mounted on the digging boom and driven for digging in the ground. An auger is provided at the base of the digging boom to disperse the spoil that is dug during the trenching operation to the sides of the trench. A support boom extends from the digging boom and is substantially parallel with the digging boom. If desired, a crumber attachment may be attached to the support boom for cleaning the bottom of the trench during the digging operation. Following the trenching operation, a substantial amount of dirt, mud, and other debris remains along side of the trench to be backfilled into the trench. Typically, this debris must be backfilled into the trench either by shoveling it by hand or by bringing in an additional plow machine to do the backfilling. Hand shoveling requires time consuming and expensive manual labor and the use of an additional machine can be expensive and logistically difficult.

A variety of plows which attach to the front of existing machines, such as forklift trucks and other vehicles, snow blowers, roto-tillers, and excavators, have been developed. These attachment plows can be used for moving a variety of materials along the ground, such as dirt or snow. Examples of such devices are disclosed in U.S. Pat. No. 4,130,952 to Dion, a plow attachment for a roto-tiller; U.S. Pat. No. 5,560,129 to Rothbart, a plow attachment for a forklift truck; and U.S. Pat. No. 4,023,287 to de Brito, a plow attachment for a snowblower. However, there are no known plow attachments that will easily and quickly attach to and detach from a trencher machine.

Accordingly, there is a need for an inexpensive and simple plow attachment for a trencher machine that can be easily and quickly attached to and detached from a trencher machine. Further, such a device is preferably adjustable vertically to different heights, and in a variety of angled positions. Moreover, because such a device may only be occasionally used, the device should be compact, requiring minimum storage space when not in use.

OBJECTS AND SUMMARY OF THE INVENTION

Therefore, it is an object of the invention to provide a cost effective plow attachment for a conventional trencher machine. It is a further object of the invention to provide a plow attachment that can easily and quickly attach and detach to the support boom of a trencher machine. It is an additional object of the invention to provide a plow attachment with an adjustable blade capable of swiveling to either side of the trencher machine for backfilling. It is yet another object of the invention to provide a plow attachment with a blade that is vertically adjustable to a variety of positions. It is a further object of the invention to provide a plow attachment that is compact and requires minimal storage space when not in use.

These and other objects are achieved in a removable blade assembly that attaches to the trencher by sliding over the support boom and is held in place by pressure point bolts. In one embodiment, the blade swivels to allow backfilling from either side of the trencher. The height of the blade can also be adjusted to a variety of positions to fill trenches after trenching.

In most existing trencher machines, a support boom is connected to the digging boom of the trenching machine and is parallel therewith. The plow attachment of the present invention includes an attachment arm which slidably mounts over the support boom of the trencher machine. An angle support and an extending support block, both welded to the attachment arm, extend therefrom and support a stabilization post. At the opposite end of the stabilization post is a blade-pivot assembly. The blade-pivot assembly includes a backfill blade which swivels to either side of the trencher and is adjustable to a variety of angles. The blade is also vertically adjustable to a variety of positions by using the trencher's hydraulic system for raising and lowering the trenching chain. Alternatively, the blade may be fixedly secured to the stabilization post.

In use, after trenching has been performed and work in the trench has been completed, backfilling is typically required. The attachment arm of the removable blade assembly slides over the support boom and is held in place by pressure point bolts. The blade can then be swiveled to either side of the trencher machine to the desired angle, as well as vertically adjusted to the appropriate level for plowing. The operator then drives the trencher machine to push the excavated material and backfill the trench.

These and other objects and advantages of the present invention will become apparent from the detailed description and accompanying drawings.

DETAILED DESCRIPTION

Figure 1:
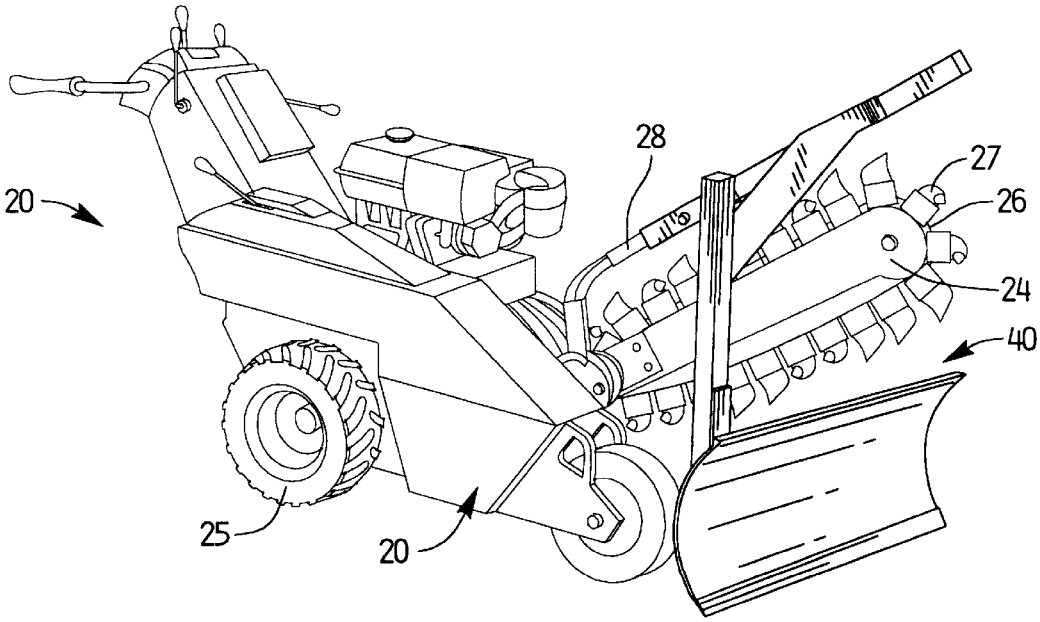
FIG. 1 is a perspective view of a removable blade assembly in accordance with the present invention for use in connection with a conventional trencher (shown in phantom) having a support boom.

Referring now to FIG. 1, a conventional trencher machine 20 includes a frame 22 supported for movement over the ground. The trencher machine 20 has an elongated digging boom 24 extending therefrom that is pivotally mounted on the frame 22 so that it can be raised and lowered relative to the frame 22 of the trencher machine 20 as selectively controlled by the operator of the trencher machine 20. A digging chain 26 with teeth 27 is mounted for orbital movement about the digging boom 24 for digging a trench in the ground. The material excavated by the digging chain 26 is carried upwardly toward the frame 22 and is pushed to the side of the trencher machine 20 by an auger (not shown). In operation, the digging boom 24 is lowered into the ground as the digging chain 26 moves about the digging boom 24 and excavates the ground. Trencher wheels 25 rotate causing the trencher machine 20 to move with respect to the ground and an elongated trench to be dug in the ground.

In most conventional trenching machines, a support boom 28 is connected to the digging boom 24 of the trencher machine 20. The support boom 28 is an elongated generally box-like member which is attached to and is substantially parallel to the digging boom 24. If desired, a crumber mechanism (see U.S. Pat. No. 5,189,817 to Schroeder) or other apparatus may be attached to the support boom 28. If a crumber attachment or other apparatus is used, it must be removed before installation of the present invention.

Figure 3:
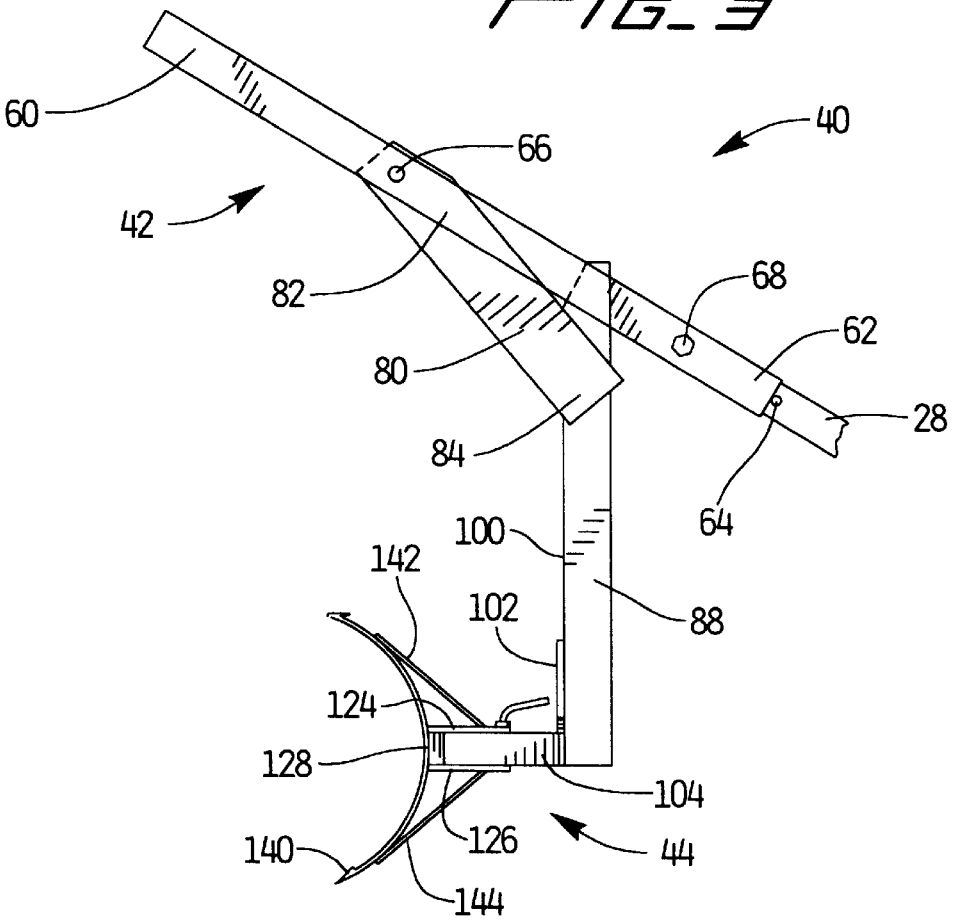
FIG. 3 is a side elevational view of a removable backfill blade assembly in accordance with the present invention.

As best shown in FIG. 3, the removable backfill blade assembly 40 includes a plow attachment frame 42, adapted to be releasably connected to the support boom 28, and a blade-pivot assembly 44, connected to the plow attachment frame 42. The plow attachment frame 42 and the blade-pivot assembly 44 of the present invention are fabricated from suitably strong materials, such as steel, which will withstand the forces subjected by the trencher 20 and the dirt and debris it backfills.

In the embodiment of the present invention shown in FIG. 3, the plow attachment frame 42 includes an attachment arm 60 which slides over the support boom 28 (see FIG. 1). Preferably, the attachment arm 60 slides onto the support boom 28 to the point where the first end 62 of the attachment arm 60 comes to rest against a bolt 64 previously located on the support boom 28. The attachment arm 60 is stabilized in place over the support boom 28 using pressure point bolts 66 and 68. Alternatively, bolts that extend through the support arm 28 may be used if corresponding holes are provided in the support boom 28.

Figure 4:
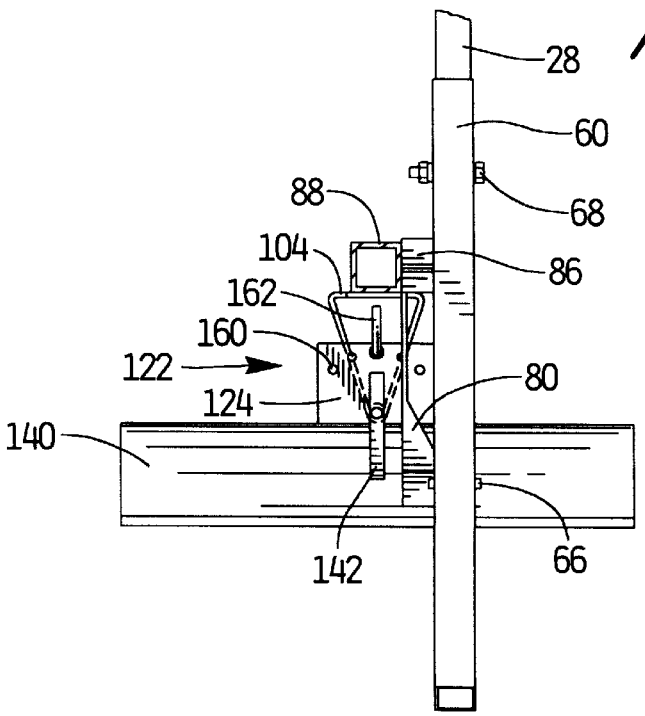
FIG. 4 is a top plan view of the backfill blade assembly of FIG. 3.

As best shown in FIGS. 3 and 4, an angle support 80 and an extending support block 86, both preferably welded or otherwise securely attached to the attachment arm 60, extend therefrom and support a stabilization post 88. The extending support block 86 generally extends from the attachment arm 60 and is welded to the stabilization post 88, providing stability and support for the stabilization post 88 and the blade-pivot assembly 44. The width of the extending support block 86 is large enough so that the stabilization post 88 may run along side and not interfere with the digging boom 24. The first end 82 of the angle support 80 is attached to the attachment arm 60 at an angle as shown in FIG. 3. The second end 84 of the angle support 80 is connected to the stabilization post 88, preferably by a weld, below the connection between the stabilization post 88 and the extending support block 86. Thus, the angle support 80 provides further stability and support for the stabilization post 88 and the blade-pivot assembly 44. Of course, other configurations of support members may be used to support the stabilization post 88 and the present invention should not be limited by the embodiment described herein.

Figure 2:
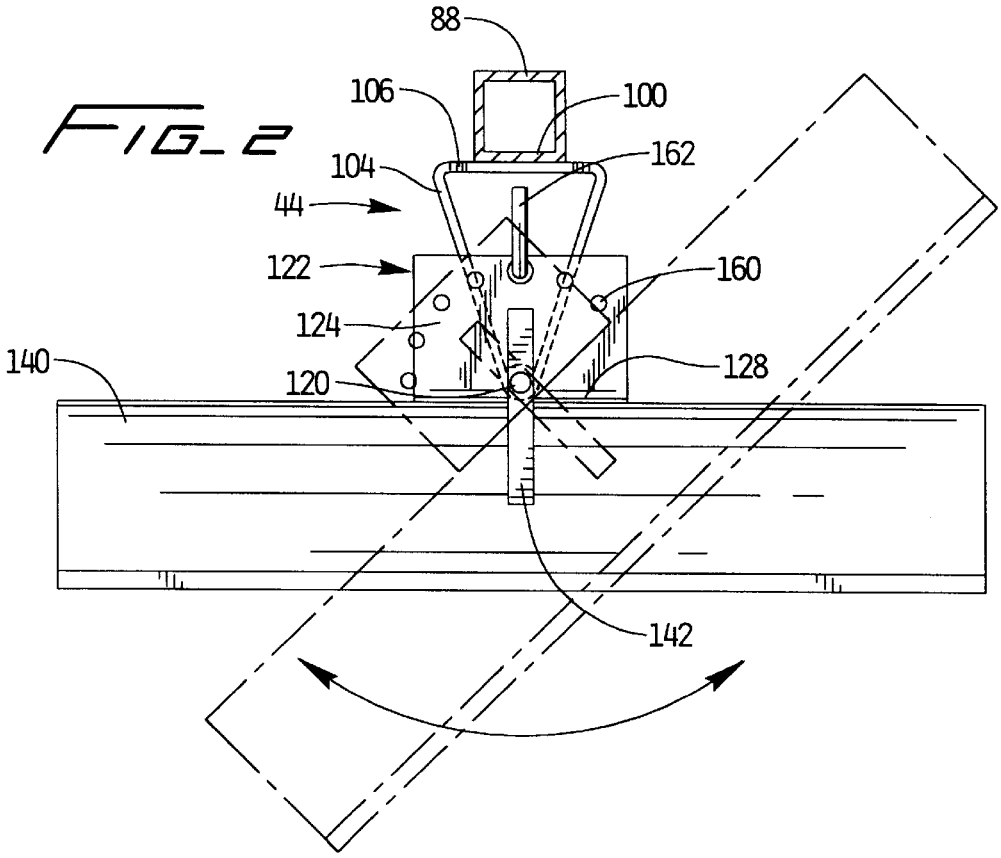
FIG. 2 is a partial top plan view of the removable blade assembly of FIG. 1, with the blade in a straight-ahead and a swiveled position (shown in phantom)

The stabilization post 88 extends downward from the angle support 80 and extending support block 86 connections and attaches to the blade-pivot assembly 44. Referring now to FIG. 2, the blade-pivot assembly 44 includes a triangular-shaped housing frame 104 welded to the front side 100 of the stabilization post 88 and extending therefrom. The triangular-shaped housing frame 104 is a triangular-shaped frame consisting of three sides and open on the top and bottom. The rearward side 106 of the triangular-shaped housing frame 104 is mounted to the front side 100 of the stabilization post 88. For further support, the rearward side 106 of the triangular-shaped housing frame 104 may contain an upward extension 102 (FIG. 3) mounted to the front side of the stabilization post 100.

To create the pivotability of the removable backfill blade assembly 40, the triangular-shaped housing frame 104 pivotally connects to the three-sided pivot block 122 opposite the rearward side 106 of the triangular-shaped housing frame. The triangular-shaped housing frame 104 inserts between the top side 124 and the bottom side 126 of the pivot block 122 to form a pivot connection 120 to the pivot block 122 at the point of the triangular-shaped housing frame 104. Any of a variety of means, e.g., a pivot pin or a bearing, may be used to effectuate the pivot connection 120.

Blade 140 is welded or otherwise attached on the front side 128 of the pivot block 122. For further support of the blade 140, a top angle iron support 142 and a bottom angle iron support 144 may be welded between the rearward side of the blade 140 and the pivot block 122. The blade 140 is generally a standard blade suitably sized and bent in a concave shape for backfilling dirt, mud, stones, and other debris. The blade 140 is preferably made of steel, but could be made of other suitably strong materials. Of course, other shapes and configurations may be used for the blade 140.

The construction of the blade-pivot assembly 44 permits swivel action to either side of the trencher machine 20. As is seen in FIG. 2, in order to move the blade 140 arcuately in a horizontal plane, the pivot block 122 and attached blade 140 may be pivotally moved about the pivot connection 120, and in this way debris such as dirt, mud and rocks, may be directed to the left or right of the trencher machine 20 when the blade 140 is thus positioned thereby facilitating further functions of a plow. A plurality of aligned openings 160 are placed in both the top side 124 and bottom side of the pivot block 126 through which a tapered pin handle 162 can be inserted. To fix the blade 140 in a desired position, the tapered pin handle 162 is removed, the blade 140 is swiveled to the desired location, and the tapered pin handle 162 is reinserted through the aligned openings 160 of the pivot block 122. The tapered pin handle 162 thereby secures the blade 140 in the desired angled position. In order to provide for height adjustment of the blade 140 with respect to the ground and the trencher machine 20, the existing hydraulic system used for raising and lowering the digging boom 24 can be used. Thus, the blade 140 is also vertically adjustable to a variety of positions.

In an alternative embodiment, the blade 140 directly attaches to the stabilization post 88 by a weld or other secure attaching means. In this embodiment, there is no pivotability of the blade 140.

In use, after trenching has been performed and backfilling is required, the removable backfill blade assembly 40 may be easily slid over the support boom 28, in one embodiment to the point where it comes to rest against stop bolt 64 located in the support boom 28. (If the trencher machine 20 was equipped with a crumber or other mechanism attached to the support boom 28, that mechanism must first be removed). The pressure point bolts 66 and 68 are then inserted through the attachment arm 60 and tightened to secure it in place to the support boom 28. In the pivotable embodiment, the tapered pin handle 162 is removed from the aligned openings 160 in the pivot block 122 so that the blade 140 can be swiveled to the desired position. The tapered pin handle 162 is then reinserted through the aligned openings 160 of the top side 124 and the bottom side 126 of the pivot block 122 to secure the pivot block 122 and the blade 140 in the desired angled position. The existing hydraulic system for raising and lowering the trenching machine 20 can be used to adjust the vertical position of the blade 140 with respect to the ground to perform the backfilling required. The trencher wheels 25 are caused to be rotated and the blade 140 is thereby moved along the ground to effectuate the backfilling objectives.

As illustrated by the foregoing description and shown in the Figures, the present invention is suitable as a removable blade assembly for a trencher machine. The present invention overcomes the limitations and disadvantages of existing trencher machines by providing a removable blade assembly which is cost effective, can easily and quickly be attached to and detached from the support boom of the trencher, is readily adjustable, and is efficiently and economically handled in the trench digging process.

Although the invention has been herein shown and described in what is perceived to be the most practical and preferred embodiments, it is to be understood that the invention is not intended to be limited to those specific embodiments. Rather, it is recognized that modifications may be made by one of skill in the art without departing from the spirit or intent of the invention. Therefore, the invention is to be taken as including all reasonable equivalents to the subject matter of the appended claims.

I claim:

1. A plow attachment for a trencher machine comprising:

an attachment arm removeably connected to the trencher machine the attachment arm removeably connected to the trencher machine by sliding over a support boom located on the trencher machine, the attachment arm tightened to the support boom by at least one pressure point bolt;

a stabilization post depending from the attachment arm; and a blade positioned with respect to the stabilization post by a blade-pivot assembly the blade-pivot assembly including a pivot block.

2. The plow attachment of claim 1 wherein an angle support stabilizes and supports the stabilization post depending from the attachment arm.

3. The plow attachment of claim 2 wherein the an extending support block further stabilizes and supports the stabilization post depending from the attachment arm.

4. The plow attachment of claim 1 wherein the positioning of the blade-pivot assembly with respect to the stabilization post is achieved using a triangular-shaped housing frame extending from the stabilization post and inserted into the pivot block of the blade-pivot assembly.

5. The plow attachment of claim 4 wherein the pivot block has a plurality of aligned openings.

6. The plow attachment of claim 5 wherein a tapered pin handle is inserted through one of the plurality of aligned openings so as to secure the blade in a desired swivel position.

7. The plow attachment of claim 1 wherein the blade is stabilized to the pivot block by a top angle iron support and a bottom angle iron support.

8. The plow attachment of claim 1 wherein the blade is stabilized to the stabilization post by the top angle iron support and the bottom angle iron support.

9. A plow attachment for a trencher machine comprising:

an attachment arm capable of being removeably connected to the trencher machine;

a stabilization post depending from the attachment arm, an angle support and an extending support block interconnecting the attachment arm and the stabilization post; and a blade-pivot assembly pivotably connected to the stabilization post at a triangular-shaped housing frame extending from the stabilization post, the blade-pivot assembly including a blade and a pivot block.

10. The plow attachment of claim 9 wherein the pivot block has a plurality of aligned openings.

11. The plow attachment of claim 10 wherein a tapered pin handle is inserted through at least one of the plurality of aligned openings so as to secure the blade in a desired swivel position.

12. A plow attachment for a trencher machine having a support boom, the plow attachment comprising:

an attachment arm adapted to be slidably mounted over the support boom;

at least one pressure point bolt securing the attachment arm over the support boom;

a stabilization post connected to the attachment arm with an angle support and an extending support block therebetween;

a triangular-shaped housing frame extending from the stabilization post;

a pivot block pivotally engaging the triangular-shaped housing frame, the pivot block having a top side, a bottom side, and a front side, the triangular-shaped housing frame inserted between the top side and bottom side of the pivot block, the top side and the bottom side of the pivot block having a plurality of aligned openings;

a blade mounted to the pivot block with a top angle iron support and a bottom angle iron support stabilizingly connecting the blade to the pivot block; and a tapered pin handle adapted to be positioned through the aligned openings of the top side and the bottom side of the pivot block so as to secure the blade in a desired swivel position.

* * * * *